US008855520B2

(12) United States Patent
Kang

(10) Patent No.: US 8,855,520 B2
(45) Date of Patent: Oct. 7, 2014

(54) IMAGE FORMING APPARATUS AND SENSING DEVICE THEREOF

(75) Inventor: Nae Wan Kang, Anyang-si (KR)

(73) Assignee: SAMSUNG Electronics Co., Ltd., Suwon-si (KR)

( * ) Notice: Subject to any disclaimer, the term of this patent is extended or adjusted under 35 U.S.C. 154(b) by 823 days.

(21) Appl. No.: 12/429,217

(22) Filed: Apr. 24, 2009

(65) Prior Publication Data

US 2009/0274478 A1 Nov. 5, 2009

(30) Foreign Application Priority Data

Apr. 30, 2008 (KR) ..... 10-2008-0040920

(51) Int. Cl.
*G03G 15/00* (2006.01)

(52) U.S. Cl.
CPC .... *G03G 15/5041* (2013.01); *G03G 2215/0005* (2013.01); *G03G 2215/00042* (2013.01)
USPC ..... 399/98

(58) Field of Classification Search
USPC ..... 399/98–100, 123, 381, 388–390
See application file for complete search history.

(56) References Cited

U.S. PATENT DOCUMENTS

2005/0095027 A1* 5/2005 Hatakeyama et al. ..... 399/98
2006/0078362 A1* 4/2006 Kim et al. ..... 399/388

FOREIGN PATENT DOCUMENTS

JP 07-320825 12/1995
JP 2003-243104 8/2003

* cited by examiner

*Primary Examiner* — Walter L Lindsay, Jr.
*Assistant Examiner* — Jessica L Eley
(74) *Attorney, Agent, or Firm* — Stanzione & Kim, LLP

(57) ABSTRACT

An image forming apparatus and a sensing device thereof. The sensing device includes a sensor, and a cleaning unit adapted to be operated by a moving printing medium and used to clean the sensor. The sensing device is operable according to delivery of a printing medium, to remove pollutants attached to the sensor.

16 Claims, 5 Drawing Sheets

IMAGE FORMING APPARATUS AND SENSING DEVICE THEREOF

CROSS-REFERENCE TO RELATED APPLICATIONS

This application claims priority under 35 U.S.C. §119 from Korean Patent Application No. 2008-0040920, filed on Apr. 30, 2008 in the Korean Intellectual Property Office, the disclosure of which is incorporated herein by reference.

BACKGROUND OF THE INVENTION

1. Field of the Invention

The present general inventive concept relates to an image forming apparatus and a sensing device thereof, and more particularly, to an image forming apparatus and a sensing device thereof capable of removing pollutants attached to a sensor.

2. Description of the Related Art

Generally, an image forming apparatus is an apparatus to print an image on paper according to input signals. Examples of the image forming apparatus include printers, copiers, facsimiles, devices combining functions thereof, and the like.

In the image forming apparatus, a light beam is irradiated onto a photosensitive member charged with a predetermined electric potential, to form an electrostatic latent image on a surface of the photosensitive member. Then, a developer is fed to the electrostatic latent image, forming a visible developer image. The developer image, formed on the photosensitive member, is transferred to a printing medium directly or by way of an intermediate transfer medium, and the transferred image is fixed to the printing medium via a fixing process. To prevent a next printing medium from being stained with a developer residue during sequential printing operations, an operation to remove the developer residue remaining on the photosensitive member is performed.

In an operation of forming the developer image by feeding the developer to the photosensitive member formed with the electrostatic latent image, if the developer is not uniformly fed to the photosensitive member, the developer cannot be fed to a desired region where the electrostatic latent image is formed, or the developer can be attached to a region except for the electrostatic latent image region, resulting in deterioration in print quality. Therefore, maintaining a desired constant thickness of a developer layer to be attached to the photosensitive member is important to maintain a constant print quality and to prevent waste of the developer. Attachment degree of the developer in relation to the photosensitive member is determined on the basis of physical and chemical properties of the developer, mounting position of a regulating blade provided in a developing container, etc.

A sensor is provided near the photosensitive member, to sense whether or not an appropriate density of developer is attached to the photosensitive member or whether or not a background phenomenon representing an irregular developer layer occurs.

However, with the conventional image forming apparatus and a sensing device thereof, since the sensor is attached to the photosensitive member or located only near the photosensitive member to sense whether or not the density of the developer, the sensor is exposed to the scattered developer. In addition, if the sensor is located in proximity to a printing medium delivery path, paper dust released from a printing medium may accumulate on the sensor. When the sensor is polluted (contaminated) with the developer, etc., it prevent a normal operation of the sensor and therefore, pollutants (contaminants) to be removed.

To remove pollutants (contaminants) accumulated on the sensor, there has been proposed a method to manually wash the sensor periodically so as to maintain functions of the sensor, or to provide the sensor with a complex configuration of a cleaning device. However, these proposed methods disadvantageously increase user's inconvenience or the price of the image forming apparatus.

SUMMARY OF THE INVENTION

The present general inventive concept provides an image forming apparatus and a sensing device thereof, which is automatically operated according to, for example, a movement or a delivery operation of a printing medium without a separate drive device and can remove pollutants (contaminants) attached to a sensor to maintain and improve performance of the image forming apparatus.

The present general inventive concept provides an image forming apparatus and a sensing device thereof, which can achieve a reduction in manufacturing costs and an improvement in ease of use, by virtue of a simplified configuration of a cleaning unit provided in the sensing device.

Additional aspects and/or advantages of the present general inventive concept will be set forth in part in the description which follows and, in part, will be obvious from the description, or may be learned by practice of the general inventive concept.

In an embodiment and utilities of the present general inventive concept, there is provided a sensing device of an image forming apparatus including a sensor and a cleaning unit to be operated by a printing medium in motion, so as to clean the sensor.

The cleaning unit may include an operating member to be pivotally rotated in contact with the printing medium in motion.

The cleaning unit may further include a cleaning member mounted to the operating member, so as to clean the sensor according to pivotal rotation of the operating member.

The operating member may include a printing medium contact portion to come into contact with the printing medium in motion, a hinge arm extending from the printing medium contact portion, and a hinge shaft provided at a distal end of the hinge arm.

The cleaning unit may further include an elastic member to return the operating member to an initial position.

The cleaning member may have one side to come into contact with a sensing portion of the sensor, and the side of the cleaning member may move along the sensing portion as the operating member is pivotally rotated.

The cleaning member may be made of flocking-treated fiber material.

In an embodiment and utilities of the present general inventive concept, there is also provided an image forming apparatus including a delivery path along which a printing medium is delivered, a sensor disposed in the vicinity of the delivery path, and a cleaning unit to clean the sensor as it moves from an initial position to an operating position by delivery force of the printing medium that is being delivered along the delivery path.

The cleaning unit may be located at the initial position by elastic force of an elastic member provided in the cleaning unit, and the cleaning unit may move to the operating position as a printing medium contact portion provided in the cleaning unit comes into contact with the printing medium that is being delivered.

The cleaning unit may include a cleaning member, and the cleaning member may come into contact with a sensing portion of the sensor to clean the sensing portion as the cleaning unit moves from the initial position to the operating position.

In an embodiment and utilities of the present general inventive concept, there is also provided an image forming apparatus including a delivery path along which a printing medium is delivered, a photosensitive member disposed on the delivery path, an optical sensor disposed in the vicinity of the photosensitive member, and a cleaning unit including an operating member disposed on the delivery path and adapted to be pivotally rotated by coming into contact with the printing medium and a cleaning member to clean the optical sensor according to pivotal rotation of the operating member.

The cleaning unit may further include an elastic member to return the operating member to an initial position.

The optical sensor may sense a developer attached to the photosensitive member or the printing medium passing through the delivery path.

In an embodiment and utilities of the present general inventive concept, there is also provide an image forming apparatus including a photosensitive member to transfer an image on a medium, an optical sensor to sense a characteristic of a developer disposed on the photosensitive member, and a cleaning unit to clean the optical sensor according to a movement of the medium.

The cleaning unit may include an operating member to move according to the movement of the medium, and a cleaning member to clean the optical sensor.

The cleaning unit may include an operating member to move according to the movement of the medium, and a cleaning member to convert the movement of the operating member into a sliding movement along a surface of the optical sensor.

The cleaning unit may include an operating member to move according to the movement of the medium, and a cleaning member attached to the operating member to protrude to remove foreign material from a surface of the optical sensor.

The cleaning unit may include an operating member having a printing medium contact portion having a portion disposed on a delivery path of the medium.

The cleaning unit may include an operating member having a printing medium contact portion having a length shorter than a width of the medium in a direction perpendicular to the delivery path of the medium.

The optical sensor and the cleaning unit may be disposed opposite to the photosensitive member with respect to a delivery path of the medium to receive the image from the photosensitive member.

BRIEF DESCRIPTION OF THE DRAWINGS

These and/or other aspects and utilities of the present general inventive concept will become apparent and more readily appreciated from the following description of the embodiments, taken in conjunction with the accompanying drawings, of which.

DETAILED DESCRIPTION OF THE PREFERRED EMBODIMENTS

Figure 1:
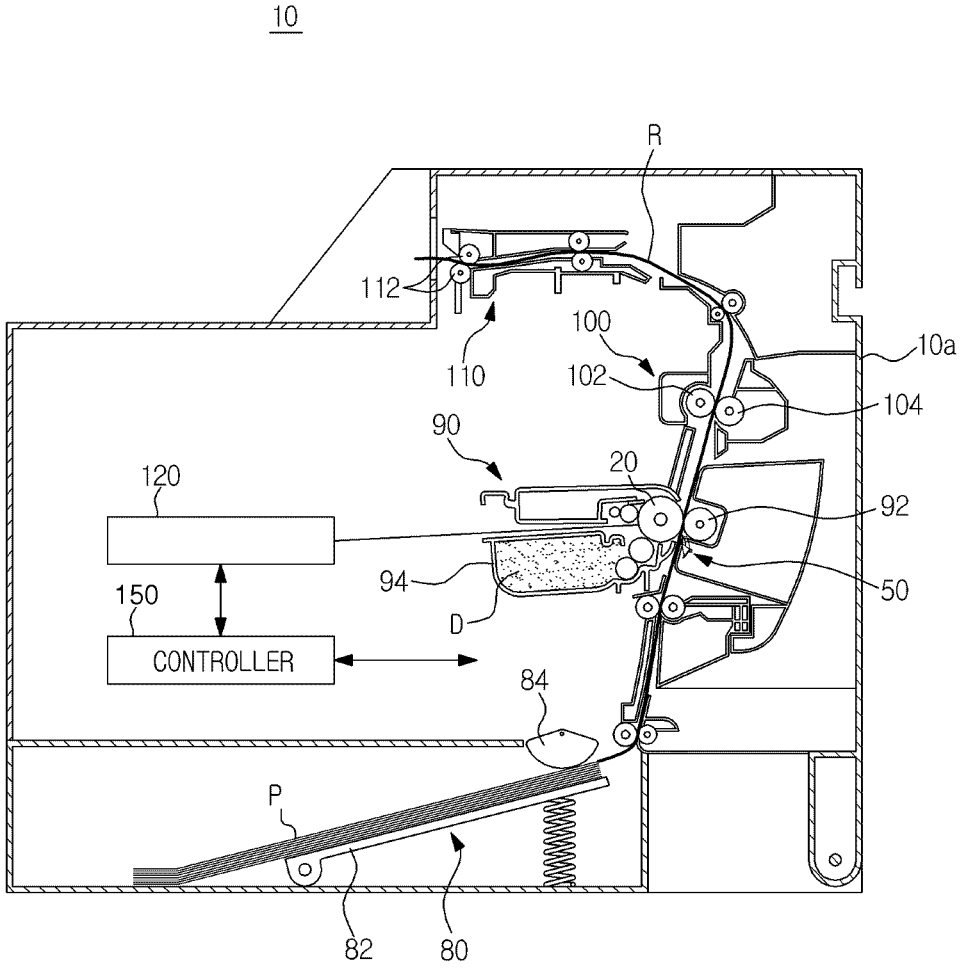
FIG. 1 is a sectional view illustrating an image forming apparatus in accordance with an exemplary embodiment of the present general inventive concept.

Reference will now be made in detail to exemplary embodiments of the present general inventive concept, examples of which are illustrated in the accompanying drawings, wherein like reference numerals refer to like elements throughout. The embodiments are described below to explain the present general inventive concept by referring to the figures.

FIG. 1 is a sectional view illustrating an image forming apparatus 10 in accordance with an exemplary embodiment of the present general inventive concept.

The image forming apparatus 10 includes a delivery path R (represented by a solid line) formed in a body of a housing 10*a* to feed a printing medium P, and a sensing device 50 located in the vicinity of the delivery path R.

The delivery path R is a path along which a printing medium R, such as paper, upon which an image is formed, is delivered. The printing medium P is loaded in a paper feeding tray 82 of a paper feeding unit 80. As a printing operation proceeds, a pickup roller 84 picks up the printing medium P sheet by sheet, and the printing medium P is fed to a developing unit 90 along the delivery path R. The developing unit 90 delivers the printing medium P along the delivery path R between a photosensitive member 20, on which an electrostatic latent image is formed by an exposure unit 120, and a transfer roller 92. While the printing medium P passes through a gap between the photosensitive member 20 and the transfer roller 92, a developer D attached to the photosensitive member 20 is transferred to the printing medium P, and the printing medium P, to which the developer D is transferred, is fed to a fixing unit 100. The developer D is fixed to the printing medium P as it is moved along the delivery path R between a heating roller 102 and a press roller 104 of the fixing unit 100. The printing medium P, having passed through the fixing unit 100, is discharged to the outside of the image forming apparatus 10 along the delivery path R between a pair of paper discharge rollers 112 of a paper discharge unit 110. That is, the delivery path R is a path along which the printing medium P, delivered from the paper feeding unit 80, is discharged to the outside by way of the developing unit 90, the fixing unit 100 and the paper discharge unit 110 in sequence. Although the description in accordance with the embodiment of the present invention exemplifies the case in which only one delivery path R is provided, there may be contemplated another case in which the printing medium P moves forward and rearward along two or more delivery paths R, so as to print images on front and rear surfaces of the printing medium P.

The image forming apparatus 10 further includes a controller 150 to control operations of elements and unit of the image forming apparatus to communicate with an external device to transmit and receive data and information, to perform an image forming operation to form an image and transfer the image to a printing image, to feed and deliver the printing medium, and to discharge the printing medium, etc.

The sensing device 50 is disposed on the delivery path R in proximity to the developing unit 90. More particularly, the sensing device 50 is disposed at a lower end of the transfer roller 92 on the opposite side of the photosensitive member 20 with respect to the delivery path R. The sensing device 50 serves to sense a characteristic, amount, or a density of the developer D attached to the photosensitive member 20, an occurrence of background phenomenon, a passage of the printing medium P along the delivery path R, etc. In addition, the sensing device 50 serves to clean a portion thereof polluted (covered or contaminated) by the scattered developer D or paper dust released from the printing medium P passing through the delivery path R. Hereinafter, the sensing device 50 will be described in detail with reference to FIGS. 2 and 3.

Figure 2:
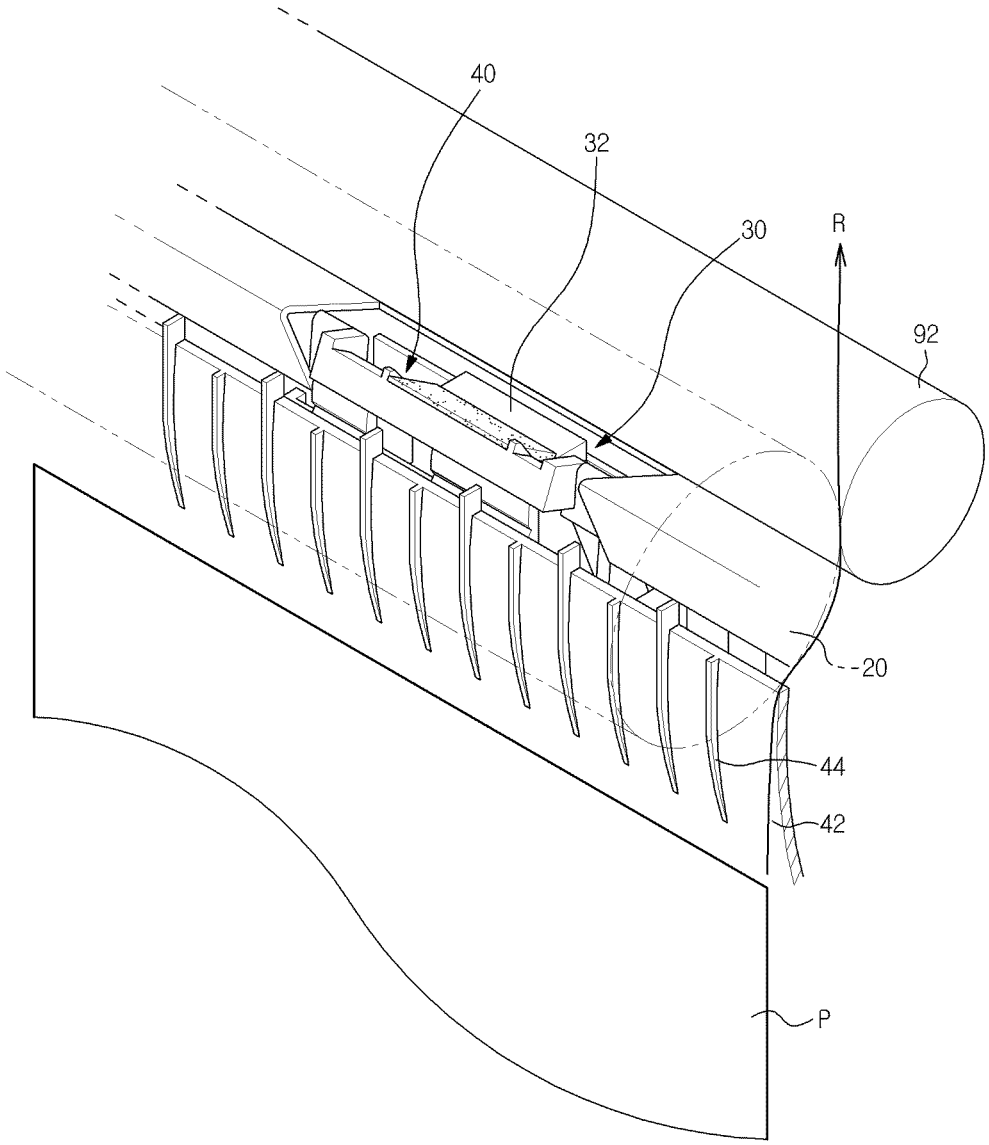
FIG. 2 is a partial perspective view illustrating a sensing device of the image forming apparatus of FIG. 1.
Figure 3:
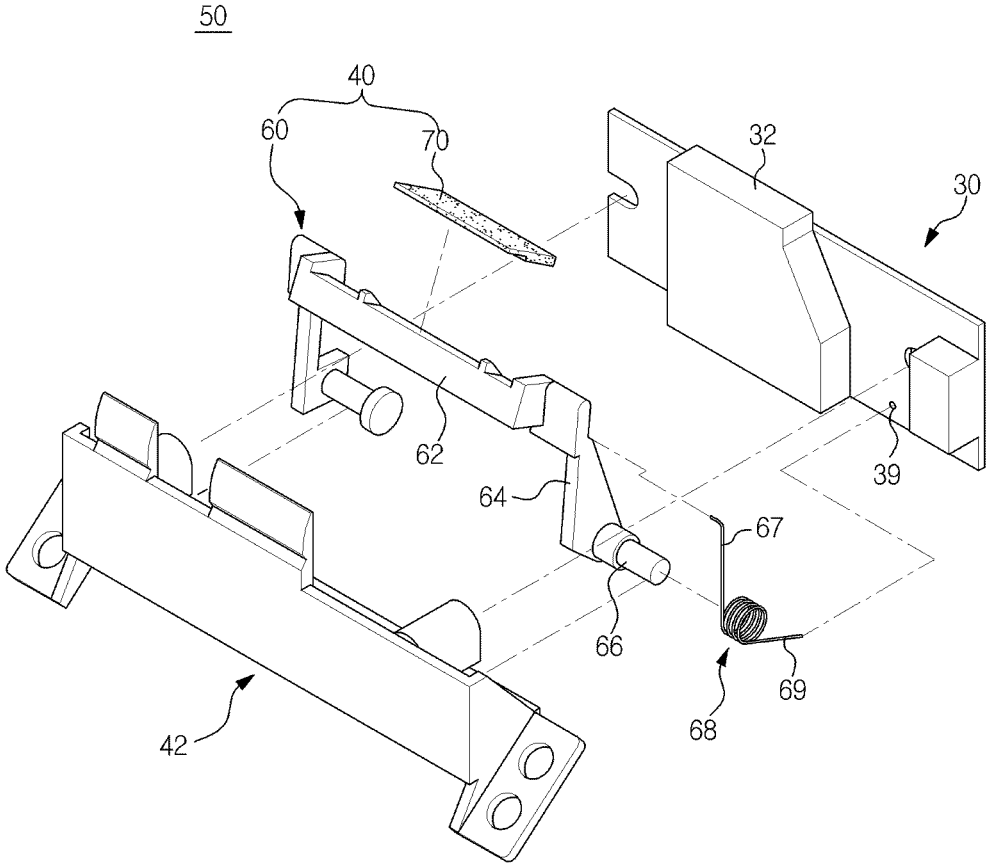
FIG. 3 is an exploded perspective view illustrating the sensing device of the image forming apparatus of FIG. 1.

FIGS. 2 and 3 are a perspective view and an exploded perspective view, respectively, illustrating the sensing device 50 of FIG. 1.

As illustrated in FIGS. 1-3, the sensing device 50 includes an optical sensor 30 and a cleaning unit 40.

The optical sensor 30 senses a signal returned after an infrared ray is irradiated toward the photosensitive member 20, to determine, for example, whether or not the developer D (FIG. 1) is appropriately attached to the photosensitive member 20. The sensed signal is transmitted to the controller 150 via a connection cable (not illustrated) and is used as basic data to control an operation of the image forming apparatus 10. The optical sensor 30 is located at a lower end of the photosensitive member 20 and has a sensing portion 32 provided at the top thereof to face the photosensitive member 20.

The sensing portion 32 is a portion to substantially sense the developer D (FIG. 1) attached to the photosensitive member 20. As described above, in a state wherein the optical sensor 30 is located at the lower end of the photosensitive member 20, the sensing portion 32, used to sense a surface of the photosensitive member 20, is oriented toward the photosensitive member 20 located above the sensing portion 32. It is possible that pollutants (contaminants or foreign material) such as the scattered developer D (FIG. 2) can accumulate on the sensing portion 32. Furthermore, since the sensing device 50, including the optical sensor 30, is provided on the delivery path R, the sensing portion 32 is easily polluted (contaminated or covered) by paper dust released from the printing medium P moving along the delivery path R. If the sensing portion 32 is polluted (contaminated or covered) by a variety of pollutants (contaminants or foreign material) accumulated thereon, it is possible that the sensing portion 32 is prevented from smoothly sensing the surface condition of the photosensitive member 20. The cleaning unit 40 is provided to prevent the above-described situation.

The cleaning unit 40 is disposed on the delivery path R for the printing medium P, and serves to remove the pollutants accumulated on the sensing portion 32 of the optical sensor 30. For this, the cleaning unit 40 is operated by a delivery force of the printing medium P by a feeding unit (not illustrated) controlled by the controller 150. Here, a separate drive device is not necessary to operate the cleaning unit 40. Since the cleaning unit 40 is operated, without the separate drive device, according to a movement of the printing medium P, for example, a contact with the printing medium P in motion, the cleaning unit 40 can effectively clean the sensing portion 32 despite a simple configuration thereof. Each constituent element of the cleaning unit 40 is attached to a holder 42 having guide ribs 44, and the holder 42 is coupled to the body of the housing 10*a* of the image forming apparatus 10. The cleaning unit 40 includes an operating member 60 and a cleaning member 70 mounted to the operating member 60. The cleaning member 70 cleans the optical sensor 30 according to a pivotal rotation of the operating member 60.

The operating member 60 is an element to be pivotally rotated in contact with the printing medium P being delivered. If the operating member 60 is pivotally rotated, the cleaning member 70 attached to the operating member 60 is pivotally rotated simultaneously, serving to remove pollutants accumulated on the sensing portion 32 of the optical sensor 30. The operating member 60 is pivotally rotated toward the optical sensor 30 when it comes into contact with the printing medium P. After the printing medium P passes through the operating member 60, the operating member 60 is returned to an initial position thereof by elastic force. The operating member 60 includes a printing medium contact portion 62, a hinge arm 64 extending from the printing medium contact portion 62, a hinge shaft 66 provided at a distal end of the hinge arm 64, and a torsion spring 68 to return the operating member 60 to the original position thereof.

The printing medium contact portion 62 is configured to come into contact with the printing medium P while the printing medium P is delivered along the delivery path R. The printing medium contact portion 62 protrudes toward the delivery path R more than the remaining portion of the operating member 60, and at least a portion of the printing medium contact portion 62 is disposed to interrupt the delivery path R to contact the printing medium P which passes through the delivery path R, whereby the printing medium P comes into contact with the printing medium contact portion 62 while being delivered along the delivery path R. Once the printing medium contact portion 62 comes into contact with the printing medium contact portion 62, the printing medium P pushes the printing medium contact portion 62 toward the optical sensor 30 while continuously moving along the delivery path R. The printing medium contact portion 62 is connected to the hinge arm 64.

The printing medium contact portion 62 has a length to correspond to a width of the printing medium perpendicular to the delivery path R. Any portion of a front edge of the printing medium P opposite to a trailing edge of the printing medium P can contact the printing medium contact portion 62 to be moved from the delivery path R toward the optical sensor 30. However, the present general inventive concept is not limited thereto. It is possible that the length of the printing medium contact portion 62 in a direction perpendicular to the delivery direction of the delivery path R can be shorter that the width of the printing medium P.

The hinge arm 64 connects the printing medium contact portion 62 and the hinge shaft 66 to each other. As will be described hereinafter, the hinge arm 64 further supports one distal end 67 of the torsion spring 68.

The hinge arms 64 may be separated from each other by a distance to correspond to the width of the printing medium passing through the delivery path R. The printing medium contact portion 62 can be connect to at least one of the hinge arms 64, and at least one of the printing medium contact portion 62 is disposed on the delivery path R. The hinge arms 64 may be disposed such that the delivery path R is disposed between the hinge arms 64.

The hinge shaft 66 is pivotally rotated by a force transmitted from the printing medium contact portion 62, or serves as a pivotal shaft about which the pivotally rotated operating member 60 is returned to the initial position thereof by elastic force of the torsion spring 68. The hinge shaft 66 is coupled, in a pivotally rotatable manner, to a shaft coupling portion (not illustrated) of the holder 42, whereby the operating member 60 is pivotally rotated about the hinge shaft 66.

The rotating axis of the hinge shaft 66 may be disposed outside the delivery path R. However, it is possible that the rotating axis of the hinge shaft 66 is disposed on a same plane of the delivery path R. In this case, the hinge shaft 66 are spaced-apart from each other to accommodate the printing medium P such that the printing medium P passes through the delivery path R without being interrupted by the hinge shafts 66 and/or the hinge arms 64.

The torsion spring 68 is coupled to the hinge shaft 66. The hinge arm 64 supports one distal end 67 of the torsion spring 68. The other distal end 69 of the torsion spring 68 is inserted into a coupling hole 39 of the optical sensor 30 to thereby be supported by the optical sensor 30. When the operating member 60 is pivotally rotated by the printing medium P with respect to a rotation center of the hinge shaft 66, the torsion spring 68 is deformed upon receiving an external force and can act to accumulate elastic force. Then, if the external force is removed after the printing medium P passes through the operating member 60, the torsion spring 68 pivotally rotates the operating member 60 to the initial position by the accumulated elastic force thereof.

The operating member 60 moves between a first position where at least a portion of the printing medium contact portion 62 is disposed to contact the printing medium P and a second position where the at least a portion of the printing medium contact portion 62 is not disposed but pushed such that the cleaning member 70 cleans the sensing portion 32. The operating member moves from the first position to the second position by a movement of the printing medium P in a contact area and also moves from the second position to the first position when the printing medium P moves away from the contact area. The contact area is disposed in the delivery path R between the photosensitive member 20 and the transfer roller such that the printing medium P can contact and push the at least the portion of the printing medium contact portion 62.

The cleaning member 70 is mounted to the operating member 60 and cleans the sensing portion 32 of the optical sensor 30 according to pivotal rotation of the operating member 60. The cleaning member 70 is coupled, at one side thereof, to the operating member 60 and, at the other side thereof, comes into contact with the sensing portion 32. While the operating member 60 is pivotally rotated by the delivery force of the printing medium P, the cleaning member 70 comes into contact with the sensing portion 32, thereby pushing pollutants, accumulated on the top of the sensing portion 32, out of the optical sensor 30. Also, even while the operating member 60 is returned to the initial position thereof by the torsion spring 68 after the printing medium P passes through the operating member 60, the cleaning member 70 continuously comes into contact with the sensing portion 32 to thereby remove the pollutants. The cleaning member 70 is made of flocking-treated fiber material. "Flocking" means a treatment to eject fine particles over a fabric. The flocking treated cleaning member 70 can more effectively remove the pollutants by the fine particles distributed on a surface thereof.

The cleaning member 70 can clean when the printing medium contact portion 62 moves from the first position to the second position. It is also possible that the cleaning member 70 can clean the optical sensor 30 when the printing medium contact portion 62 moves from the second position to the first position. It is also possible that the cleaning member 70 can clean when the printing medium contact portion 62 moves from the first position to the second position and from the second position to the first position.

Hereinafter, operations of the image forming apparatus 10 and the sensing device 50 thereof in accordance with the embodiment of the present general inventive concept, having the above-described configurations, will be described with reference to FIGS. 4 and 5.

Figure 4:
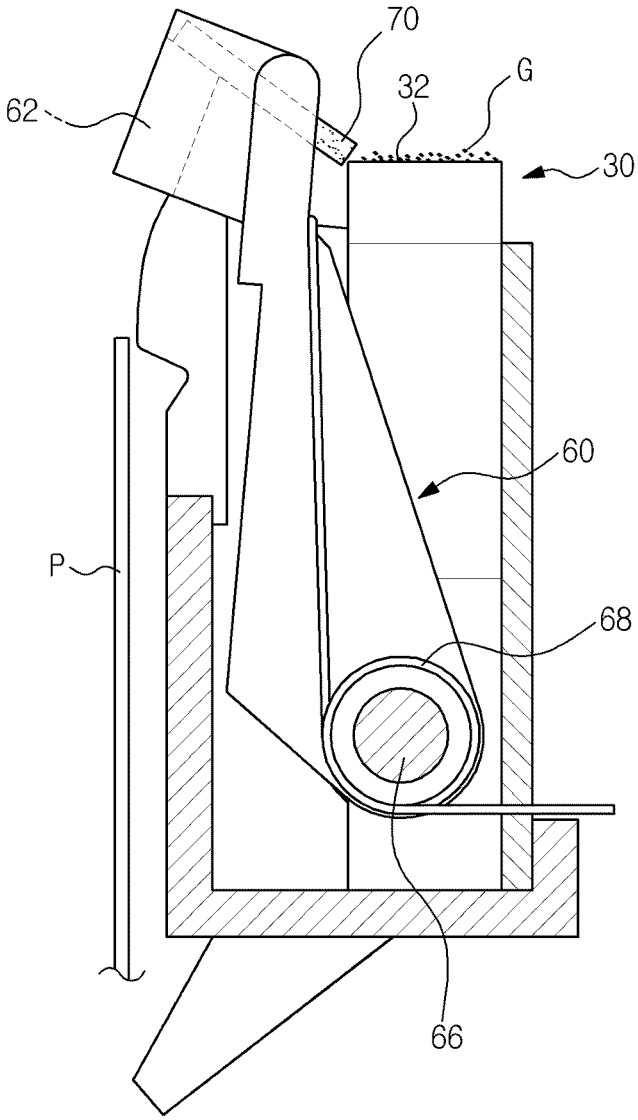
FIG. 4 is a side view illustrating an initial position of the sensing device.
Figure 5:
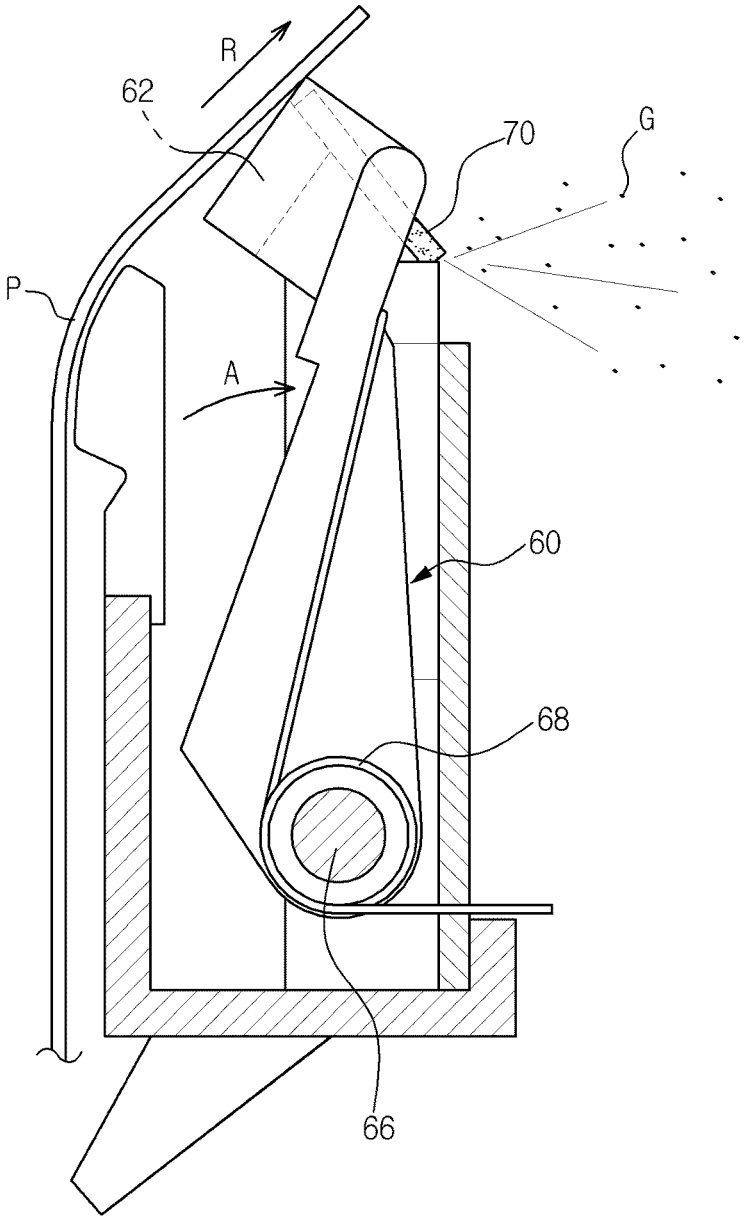
FIG. 5 is a side view illustrating an operating position of the sensing device.

FIGS. 4 and 5 are side sectional views illustrating an initial position (or first position) and an operating position (or second position) of the sensing device 50, respectively.

As illustrated in FIGS. 1-5, the operating member 60 is kept in the initial position thereof under the influence of elastic force of the torsion spring 68 before the printing medium P accesses the operating member 60. In this case, the sensing portion 32 of the optical sensor 30 is oriented to face upward, in order to sense the surface of the photosensitive member 20 (FIG. 2) located above the sensing portion 32 and therefore, various pollutants G may be accumulated on the sensing portion 32.

If the printing medium P, which is delivered along the delivery path R, is brought into contact with the printing medium contact portion 62 of the operating member 60, the operating member 60 is pivotally rotated in a clockwise direction A by the delivery force of the printing medium P, thereby being moved to an operating position thereof.

As the operating member 60 is moved to the operating position, the cleaning member 70, which comes into contact with the sensing portion 32, sweep away the pollutants G, accumulated on the sensing portion 32, out of the sensing portion 32.

Then, if the printing medium P is further moved along the delivery path R and no longer comes into contact with the printing medium contact portion 62, the operating member 60 is moved in a counterclockwise direction B (reverse direction of the direction A) by elastic force of the torsion spring 68, being returned to the initial position thereof. Even while the operating member 60 is moved to the original position, the cleaning member 70 is moved while continuously coming into contact with the sensing portion 32 and thus, can remove the pollutants G remaining on the sensing portion 32.

The cleaning member 70 may be flexible such that at least a portion of the cleaning member 70 can move along a surface of the sensing portion 32. Here, the surface of the sensing portion 32 may be a surface of a window through which a light beam or a sensing signal can transmit to detect a characteristic of the developer formed on the photosensitive member 20. a The cleaning member 70 may have an area larger than an area of the printing medium contact portion 62, and may be attached to the printing medium contact portion 62. The portion of the cleaning member 70 may have a first portion attached to the printing medium contact portion 62 and a second portion extended from the first portion to remove the pollutants disposed on the surface of the sensing portion 32. Since the second portion is flexible, it is possible that the second portion can slide along the surface of the printing medium contact portion when the operating member 60 rotates. Accordingly, a rotation movement of the operating member 60 is converted to a sliding movement of the second portion of the cleaning member 70.

When the second portion of the cleaning member 70 is flexible, the cleaning member 70 can clean the optical sensor 30 or remove the pollutants from the optical sensor 30 regardless of a shape of the surface of the sensing portion 32. Accordingly, when the surface of the sensing portion 32 has a curved surface, the cleaning member 70 can perform the above-describe cleaning operation along the curved surface according to a rotation movement of the operating member 60. When the surface of the sensing portion 32 does not have the same curvature as the rotation movement of the operating member 60 it is possible that the cleaning member 70 can perform the cleaning operation along the curved surface.

Although FIG. 1 illustrates the image forming apparatus 10, the present general inventive concept is not limited thereto. Other types of image forming apparatuses can be used as the image forming apparatus 10. That is, it is possible that an image forming apparatus with a transfer belt as a medium to receive the developed image from the photosensitive member 20 and transfer a printing medium. In this case, the delivery path R can be formed between the photosensitive member 20 and the transfer belt, and the sensing device 50 can be disposed adjacent to the transfer belt to detect the characteristic of the developer disposed on the photosensitive member 20. The operating member 60 of the cleaning unit 40 can move according to a contact with at least a portion of the transfer belt.

Although the above-described embodiment describes the case of the operating member being returned to the initial position by the torsion spring, it will be appreciated that the operating member may be moved to the original position by weight when it is tilted.

Further, although the above-described embodiment describes the case of the printing medium being brought into contact with the printing medium contact portion located at the distal end of the operating member, it will be appreciated that the contact position between the printing medium and the operating member is not limited thereto.

As apparent from the above description, the present general inventive concept provides an image forming apparatus and a sensing device thereof, which is operable by delivery force of a printing medium without a separate drive device so as to remove pollutants attached to a sensor, thereby maintaining performance of the image forming apparatus.

Further, the image forming apparatus and the sensing device thereof according to the present general inventive concept can achieve a reduction in manufacturing costs and an improvement in easy of use, by virtue of a simplified configuration of a cleaning unit provided in the sensing device.

Although embodiments of the present general inventive concept have been shown and described, it would be appreciated by those skilled in the art that changes may be made in this embodiment without departing from the principles and spirit of the general inventive concept, the scope of which is defined in the claims and their equivalents.

What is claimed is:

1. A sensing device of an image forming apparatus having a photosensitive member, comprising:

a sensor to sense a characteristic of a developer disposed on the photosensitive member; and a cleaning unit to clean the sensor in response to a motion of a printing medium on which an image is to be fixed, the printing medium moving along a delivery path, where the cleaning unit is disposed upstream of the photosensitive member along the delivery path, the cleaning unit having a cleaning member mounted to an operating member, the cleaning member being disposed at an angle to the sensor with one side of the cleaning member to clean the sensor according to a pivotal rotation of the operating member in response to contact with the printing medium.

2. The sensing device according to claim 1, wherein the operating member includes:

a printing medium contact portion to contact the printing medium;

a hinge arm extending from the printing medium contact portion; and a hinge shaft provided at a distal end of the hinge arm.

3. The sensing device according to claim 1, wherein the cleaning unit further includes an elastic member to return the operating member to an initial position.

4. The sensing device according to claim 1, wherein the one side of the cleaning member moves along the sensing portion as the operating member is pivotally rotated.

5. The sensing device according to claim 1, wherein the cleaning member is made of flocking-treated fiber material.

6. An image forming apparatus comprising:

a photosensitive member disposed on the delivery path to transfer an image on the printing medium;

a delivery path along which a printing medium, on which an image is to be fixed, is delivered;

a sensor disposed in the vicinity of the delivery path; and a cleaning unit disposed upstream of the photosensitive member along the delivery path to clean the sensor as the cleaning unit moves from an initial position to an operating position according to an application of a delivery force by the printing medium delivered along the delivery path, the cleaning unit having a cleaning member that is disposed at an angle to the sensor with one side of the cleaning member to clean the sensor as the cleaning unit moves from the initial position to the operating position.

7. The image forming apparatus according to claim 6, wherein the cleaning unit is located at the initial position according to an elastic force of an elastic member provided in the cleaning unit, and the cleaning unit moves to the operating position as a printing medium contact portion provided in the cleaning unit contacts the printing medium delivered along the delivery path.

8. An image forming apparatus comprising:

a delivery path along which a printing medium, on which an image is to be fixed, is delivered;

a photosensitive member disposed on the delivery path;

an optical sensor disposed in the vicinity of the photosensitive member; and a cleaning unit including an operating member disposed upstream of the photosensitive member along the delivery path and adapted to be pivotally rotated according to contact with the printing medium and a cleaning member being disposed at an angle to the optical sensor with one side of the cleaning member to clean the optical sensor according to the pivotal rotation of the operating member.

9. The image forming apparatus according to claim 8, wherein the cleaning unit further includes an elastic member to return the operating member to an initial position.

10. The image forming apparatus according to claim 8, wherein the optical sensor senses a developer attached to the photosensitive member or the printing medium passing through the delivery path.

11. An image forming apparatus comprising:

a photosensitive member to transfer an image on a medium;

an optical sensor to sense a characteristic of a developer disposed on the photosensitive member; and a cleaning unit disposed upstream of the photosensitive member along a medium delivery path to clean the optical sensor according to a movement of the medium in which the image is to be fixed, the cleaning unit having a cleaning member mounted to an operating member, the cleaning member being disposed at an angle to the optical sensor with one side of the cleaning member to clean the optical sensor according to a pivotal rotation of the operating member in response to contact with the medium.

12. The image forming apparatus of claim 11, wherein the cleaning member converts the movement of the operating member into a sliding movement along a surface of the optical sensor.

13. The image forming apparatus of claim 11, wherein the cleaning member is attached to the operating member to protrude to remove foreign material from a surface of the optical sensor.

14. The image forming apparatus of claim 11, wherein the operating member has a printing medium contact portion having a portion disposed on the delivery path of the medium.

15. The image forming apparatus of claim 11, wherein the operating member has a printing medium contact portion having a length shorter than a width of the medium in a direction perpendicular to the delivery path of the medium.

16. The image forming apparatus of claim 11, wherein the optical sensor and the cleaning unit are disposed opposite to the photosensitive member with respect to a delivery path of the medium to receive the image from the photosensitive member.

* * * * *